US007173578B2

(12) United States Patent
Kim et al.

(10) Patent No.: US 7,173,578 B2
(45) Date of Patent: Feb. 6, 2007

(54) METHOD AND APPARATUS FOR DRIVING A PLASMA DISPLAY PANEL IN WHICH RESET DISCHARGE IS SELECTIVELY PERFORMED

(75) Inventors: Jin-sung Kim, Anyang (KR); Jin-boo Son, Busan Metropolitan (KR)

(73) Assignee: Samsung SDI Co., Ltd., Suwon (KR)

( * ) Notice: Subject to any disclaimer, the term of this patent is extended or adjusted under 35 U.S.C. 154(b) by 636 days.

(21) Appl. No.: 10/095,531

(22) Filed: Mar. 13, 2002

(65) Prior Publication Data

US 2002/0135542 A1 Sep. 26, 2002

(30) Foreign Application Priority Data

Mar. 23, 2001 (KR) ..... 2001-15246
Oct. 10, 2001 (KR) ..... 2001-62355

(51) Int. Cl.
*G09G 3/28* (2006.01)

(52) U.S. Cl. ..... 345/60; 345/67; 315/169.4

(58) Field of Classification Search ..... 345/60–67; 315/169.1, 169.3, 169.4
See application file for complete search history.

(56) References Cited

U.S. PATENT DOCUMENTS 6,034,482 A * 3/2000 Kanazawa et al. ..... 315/169.4
6,124,849 A * 9/2000 Ito et al. ..... 345/204
RE37,083 E * 3/2001 Kanazawa ..... 315/169.4
6,320,560 B1 * 11/2001 Sasaki et al. ..... 345/60
6,331,842 B1 * 12/2001 Nozu et al. ..... 345/60
6,512,501 B1 * 1/2003 Nagaoka et al. ..... 345/66
6,603,447 B1 * 8/2003 Ito et al. ..... 345/60
6,608,609 B1 * 8/2003 Setoguchi et al. ..... 345/60
2002/0021264 A1 * 2/2002 Nakamura ..... 345/60

FOREIGN PATENT DOCUMENTS

| | | |
|---|---|---|
| EP | 0 680 067 A2 | 11/1995 |
| EP | 0 989 538 A2 | 3/2000 |
| JP | 10171403 | 6/1998 |
| JP | 10228259 | 8/1998 |
| JP | 2000-89720 | 3/2000 |
| JP | 2000-242224 | 9/2000 |

* cited by examiner

*Primary Examiner*—Richard Hjerpe
*Assistant Examiner*—Kimnhung Nguyen
(74) *Attorney, Agent, or Firm*—H. C. Park & Associates, PLC

(57) ABSTRACT

A method and apparatus for driving a plasma display panel in which a reset discharge is selectively performed with regard to the distribution of wall charges in discharge cells are provided. The method includes applying a reset signal for preventing a reset discharge from occurring in cells having conditions under which an address discharge can occur during the address period and allowing a reset discharge occur in cells which do not have the above conditions. Accordingly, an unnecessary discharge can be suppressed, thereby making a dark portion darker. Therefore, contrast can be greatly improved, and a time for a reset period can be reduced.

30 Claims, 9 Drawing Sheets

METHOD AND APPARATUS FOR DRIVING A PLASMA DISPLAY PANEL IN WHICH RESET DISCHARGE IS SELECTIVELY PERFORMED

BACKGROUND OF THE INVENTION

1. Field of the Invention

The present invention relates to a method and apparatus for driving a plasma display panel used for displaying images in a television set or a computer monitor, and more particularly, to a method and apparatus for driving a plasma display panel in which a reset discharge is selectively performed with regard to the distribution of wall charges in discharge cells.

2. Description of the Related Art

Panel driving timing can be divided into a reset (initialization) period, an address period, a sustain period and an erasing period. During the reset period, the state of each cell is initialized for smooth cell addressing. During the address period, cells to be turned on and cells not to be turned on are selected from a panel and wall charges are accumulated at the cells to be turned on. During the sustain period, a discharge is generated in addressed cells to actually display an image. During the erasing period, wall charges of cells are reduced to terminate a sustain discharge.

Contrast is an important factor affecting the quality of an image produced by a plasma display panel. Contrast is represented by the ratio of the brightness of a bright portion to the brightness of a dark portion in a picture displayed on a panel. The bright portion mainly comes from light generated by a sustain discharge, and the dark portion comes from light generated by a reset discharge. Contrast is enhanced by either increasing the brightness of the bright portion or decreasing the brightness of the dark portion.

FIG. 1 is a perspective view of a part of an AC plasma display panel. Pairs of a scan electrode 4 and a sustain electrode 5 which are covered with a dielectric layer 2 and a protective layer 3 are formed to be parallel to one another on a first glass substrate 1. A plurality of address electrodes 8 covered with an insulator layer 7 are formed on a second glass substrate 6. Partition walls 9 are formed on the insulator layer 7 to be parallel to the address electrodes 8. A phosphor layer 10 is formed on the surface of the insulator layer 7 and both sides of the partition walls 9. The first glass substrate 1 and the second glass substrate 6 are disposed to face each other with a discharge space 11 therebetween so that the scan electrodes 4 and the sustain electrodes 5 are orthogonal to the address electrodes 8. The discharge space 11 at an intersection between each address electrode 8 and each pair of a scan electrode 4 and a sustain electrode 5 forms a discharge cell 12.

FIG. 2 is a diagram of an electrode array in a panel. Electrodes form a matrix having m columns and n rows. Address electrodes $A_1$ through $A_m$ are arrayed in columns. Scan electrodes $SCN_1$ through $SCN_n$ and sustain electrodes $SUS_1$ through $SUS_n$ are arrayed in rows. A discharge cell shown in FIG. 2 corresponds to the discharge cell 12 shown in FIG. 1.

FIG. 3 is a timing chart of driving waveforms according to a conventional method of driving a panel. In this driving method, one frame period is composed of 8 subfields for a 256 gray scale. Each subfield is composed of a reset period, an address period, a sustain period, and an erasing period. Operations in a first subfield will now be described below.

During an early stage of a reset period, all address electrodes $A_1$ through $A_m$ and all sustain electrodes $SUS_1$ through $SUS_n$ are maintained at 0 V. A ramp voltage signal is applied to all scan electrodes $SCN_1$ through $SCN_n$. The ramp voltage starts from a voltage $V_p$, which is no greater than a discharge start voltage with respect to the sustain electrodes $SUS_1$ through $SUS_n$, and is slowly increased toward a voltage $V_r$, which is greater than the discharge start voltage. While the ramp voltage is increasing, a first faint reset discharge occurs from a scan electrode toward an address electrode and a sustain electrode in all discharge cells. As a result, negative wall charges are accumulated on the surface of a protective layer on each scan electrode. Simultaneously, positive wall charges are accumulated on the surface of an insulator layer on each address electrode and the surface of the protective layer on each sustain electrode.

During the latter stage of the reset period, all the sustain electrodes $SUS_1$ through $SUS_n$ are maintained at a constant voltage $V_h$. The ramp voltage is varied to all scan electrodes $SCN_1$ through $SCN_n$ starting from a voltage $V_q$, which is no greater than a discharge start voltage with respect to the sustain electrodes $SUS_1$ through $SUS_n$, and is slowly decreased toward a 0 voltage greater than the discharge start voltage. While the ramp voltage is decreasing, a second faint reset discharge occurs from a sustain electrode toward a scan electrode in all the discharge cells. As a result, the negative wall charge of the surface of the protective layer on each scan electrode and the positive wall charge of the surface of the protective layer on each sustain electrode are decreased. In addition, a faint discharge occurs between an address electrode and a scan electrode, and the positive wall charge of the surface of the insulator layer on each address electrode is adjusted to a value suitable for addressing operation. With such an arrangement, a reset operation is completed during the reset period.

Next, during an address period, all scan electrodes $SCN_1$ through $SCN_n$ are maintained at a voltage $V_s$. A positive address pulse voltage $+V_w$ is applied to a predetermined address electrode $A_j$ (j is an integer between 1 and m) corresponding to a discharge cell to be displayed on a first row, and simultaneously, a scan pulse voltage of 0 V is applied to the scan electrode $SCN_1$ on the first row. Here, a voltage between the surface of the insulator layer and the surface of the protective layer on the scan electrode $SCN_1$, at the intersection between the address electrode $A_j$ and the scan electrode $SCN_1$, is the sum of the address pulse voltage $+V_w$ and the positive wall voltage of the surface of the insulator layer on each address electrode. As a result, an address discharge occurs between the predetermined address electrode $A_j$ and the scan electrode $SCN_1$ and between the sustain electrode $SUS_1$ and the scan electrode $SCN_1$, at the above intersection. Accordingly, at the intersection, a positive wall charge is accumulated on the surface of the protective layer on the scan electrode $SCN_1$, a negative wall charge is accumulated on the surface of the protective layer on the sustain electrode $SUS_1$, and a negative wall charge is accumulated on the surface of the insulator layer on the address electrode $A_j$.

A sustain period follows the address period. During the sustain period, all the scan electrodes $SCN_1$ through $SCN_n$ and all the sustain electrodes $SUS_1$ through $SUS_n$ are maintained at 0 V, and then a positive sustain pulse voltage $+V_m$ is applied to all the scan electrodes $SCN_1$ through $SCN_n$. Here, a voltage between the surface of the protective layer on the scan electrode $SCN_i$ (i is an integer between 1 and n) and the surface of the protective layer on each sustain electrode, in a discharge cell in which an address discharge has occurred, is the sum of a sustain pulse voltage, a positive wall charge accumulated on the surface of the protective layer on the scan electrode $SCN_1$ during the address period, and a negative wall charge accumulated on the surface of the protective layer on the sustain electrode $SUS_1$ during the address period, which is greater than a discharge start voltage. As a result, a sustain discharge occurs between a scan electrode and a sustain electrode in a discharge cell in which the address discharge has occurred. In the discharge cell in which the sustain discharge has occurred, a negative wall voltage is accumulated on the surface of the protective layer on the scan electrode, and a positive wall voltage is accumulated on the surface of the protective layer on the sustain electrode. Thereafter, the sustain pulse voltage applied to the scan electrode becomes 0 V. Subsequently, a positive sustain pulse voltage $+V_m$ is applied to all the sustain electrodes $SUS_1$ through $SUS_n$, and through the same procedure as described above, a sustain discharge occurs between a scan electrode and a sustain electrode in a discharge cell in which the address discharge has occurred. Thereafter, through the same method as described above, a positive sustain pulse voltage is alternately applied to all scan electrodes $SCN_1$ through $SCN_n$ and all the sustain electrodes $SUS_1$ through $SUS_n$, thereby performing a sustain discharge. Such a sustain discharge excites phosphor, thereby generating visible light rays used for displaying an image.

After the sustain period ends, during an erasing period, a ramp voltage starting from 0 V and increasing toward a voltage $+V_e$ is applied to all the sustain electrodes $SUS_1$ through $SUS_n$. Here, in a discharge cell in which a sustain discharge has occurred, a voltage between the surface of the protective layer on a scan electrode and the surface of the protective layer on a sustain electrode is the sum of a negative wall charge on the protective layer on the scan electrode at the last point of the sustain period, a positive wall charge on the protective layer on the sustain electrode at the last point of the sustain period, and the ramp voltage. As a result, a weak erasing discharge occurs between the sustain electrode and the scan electrode in the discharge cell in which the sustain discharge has occurred. In addition, the negative wall charge on the protective layer on the scan electrode and the positive wall charge on the protective layer on the sustain electrode decrease, thereby stopping the sustain discharge. With such arrangement, an erasing operation is completed.

According to conventional technology, a dark portion on a plasma display panel comes from light generated by a reset discharge. When such a reset discharge starts for a single subfield, the reset discharge occurs in all cells. Accordingly, the reset discharge occurs and generates light even in discharge cells which are supposed to be already turned off, thereby reducing contrast.

SUMMARY OF THE INVENTION

To solve the above-described problems, it is an object of the present invention to provide a method and apparatus for driving a plasma display panel, through which a dark portion can be displayed to be darker to enhance contrast by selectively performing a reset discharge during a panel display driving operation.

To achieve the above object, in one embodiment, there is provided a method of driving a plasma display panel. The method includes a reset period for initializing the state of each cell, an address period for discriminating cells to be turned on from cells not to be turned on during a sustain period and for performing an addressing operation, and a sustain period for discharging addressed cells. The method includes applying a reset signal for preventing a reset discharge from occurring in cells having conditions under which an address discharge can occur during the address period and allowing a reset discharge to occur in cells which do not have the above conditions. Preferably, the reset signal is applied so that a reset discharge is generated in a cell having a wall charge structure in which an address discharge cannot occur even if an address voltage is applied during the address period, or in a cell having a wall charge structure in which a sustain discharge occurs during the sustain period even if an address discharge does not occur during the address period, when determined based on the wall charge structure of the cell at the beginning of the reset period.

In another embodiment, there is provided a method of driving a plasma display panel. The method includes a reset period for initializing the state of each cell, an address period for discriminating cells to be turned on from cells not to be turned on during a sustain period and for performing an addressing operation, and a sustain period for discharging addressed cells. The method includes applying a reset waveform during the reset period, wherein a reset pulse having a predetermined voltage level is applied in an early stage of the reset period, and a ramp pulse having a gradually decreasing voltage level is applied in a latter stage of the reset period. Preferably, a reset discharge is prevented from occurring in a cell having conditions under which an address discharge can occur therein due to an address voltage during the address period, when determined based on the wall charge structure of the cell at the beginning of the reset period.

In still another embodiment, there is provided a method of driving a plasma display panel. The method includes a reset period for initializing the state of each cell, an address period for discriminating cells to be turned on from cells not to be turned on during a sustain period and for performing an addressing operation, and a sustain period for discharging addressed cells. The method includes applying a reset voltage to a scan electrode in the reset period while voltages applied to sustain and address electrodes, respectively, are maintained constant so that a reset discharge substantially occurs between the scan and address electrodes and is substantially prevented from occurring between the scan and sustain electrodes.

To achieve the above object, there is also provided an apparatus for driving a plasma display panel. The apparatus includes a reset signal generator for generating a reset signal for initializing the state of each cell; an address signal generator for generating an address signal for discriminating a cell to be turned on from a cell not to be turned on and performing an addressing operation; and a sustain signal generator for generating a sustain signal for discharging a cell addressed by the address signal generator. The reset signal generator generates the reset signal to prevent a reset discharge from occurring in a cell satisfying conditions under which an address discharge can be normally performed due to the address signal and to generate a reset discharge in a cell which does not satisfy the conditions. Preferably, the reset signal generator applies a reset pulse having a predetermined voltage level in an early stage of a reset period and applies a ramp pulse having a gradually decreasing voltage level in a latter stage of the reset period.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Hereinafter, embodiments of the present invention will be described in detail with reference to the attached drawings.

The present invention relates to a method for enhancing contrast by suppressing unnecessary reset discharges in a plasma display panel. According to this method, during a reset period, a reset discharge does not occur in a cell meeting addressing conditions and only occurs in a cell not meeting the addressing conditions, in order to minimize light to be generated at a dark portion of a panel. During the reset period, a proper amount of wall charges having a proper polarity are formed at each of an address electrode, a sustain electrode and a scan electrode in order to adjust the distribution of wall charges so that an addressing operation can be smoothly performed during an address period. Here, the "addressing conditions" indicate conditions on which the addressing operation of discriminating cells to be turned on from cells not to be turned on during a sustain discharge in the address period can be accurately performed. Accordingly, a cell having wall charges, which allow normal operation during an address period and sustain period even if a reset discharge does not occur during the reset period, is referred to as a cell meeting the addressing conditions. A cell which does not have such wall charges is referred to as a cell not meeting the addressing conditions.

A small or moderate amount of negative or positive charges should be accumulated on a sustain (X) electrode in an address period to form an appropriate wall voltage between the sustain and scan electrodes so that a sustain discharge is smoothly performed between the sustain electrode and the scan electrode by a sustain voltage applied in a sustain period subsequent to the address period. In order to satisfy the addressing conditions in a discharge cell, a large amount of negative charges should be accumulated on a scan electrode, a large amount of positive charges should be accumulated on an address electrode, and a moderate amount of negative charges or a small amount of positive charges should be accumulated on a sustain electrode according to a bias voltage to be applied to the sustain electrode during an address period. In addition, when an address discharge has not occurred in the discharge cell during the address period, enough wall charges not to provoke discharge during a sustain period should remain on the sustain and scan electrodes. Accordingly, the present invention prevents a reset discharge from occurring in a discharge cell satisfying the addressing conditions, as described above, and generates a reset discharge in a discharge cell which does not satisfy the addressing conditions to make the discharge cell satisfy the addressing conditions.

Figure 4:
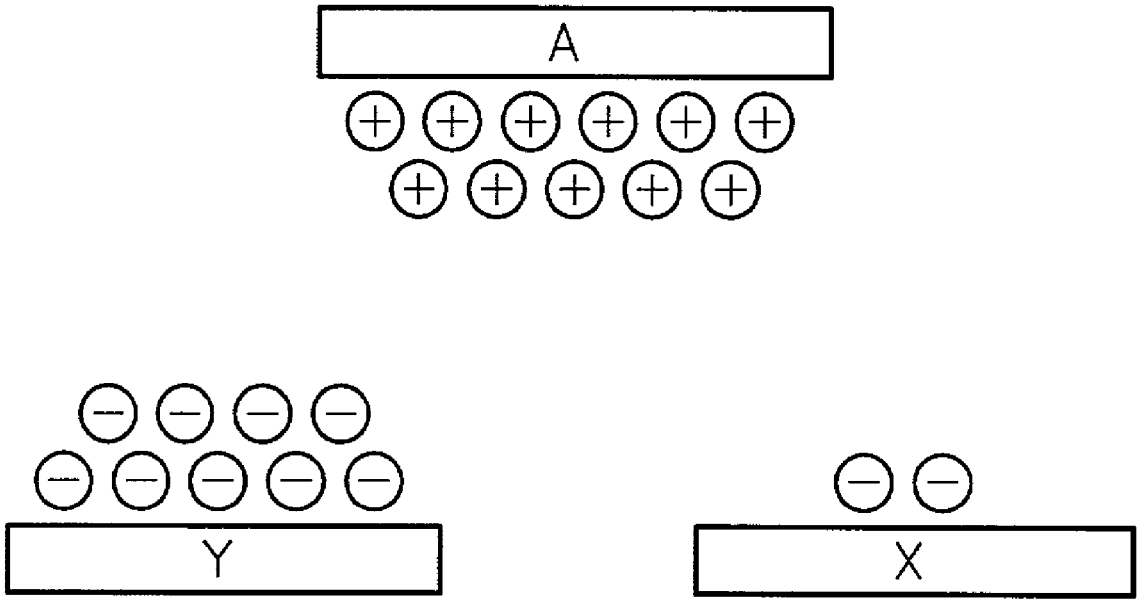
FIG. 4 is a diagram of the structure of wall charges in a discharge cell meeting addressing conditions.

FIG. 4 is a diagram of the structure of wall charges in a discharge cell meeting addressing conditions. A large amount of negative charges should be accumulated on a scan electrode Y and a large amount of positive charges should be accumulated on an address electrode A so that enough wall charges to generate an address (write) discharge can be formed when an address voltage and a scan voltage are applied to the address electrode A and the scan electrode, respectively, during an address period. Here, a moderate amount of negative charges or a small amount of positive charges should be accumulated at a sustain electrode X according to a bias voltage to be applied to the sustain electrode X during an address period.

In other words, FIG. 4 shows a case having wall charge conditions under which an address discharge can occur during an address period even if a reset discharge has not occurred in a reset period. That is, when an address pulse is applied to the address electrode A during the address period, and simultaneously, a scan pulse is applied to the scan electrode Y, a discharge should occur between the address electrode A and the scan electrode Y due to a wall voltage formed between the two electrodes A and Y and the pulse voltages applied to the two electrodes A and Y.

In contrast, in the case where in an arbitrary cell, an address pulse is not applied to an address electrode and a scan pulse is applied to a scan electrode during an address period (that is, in the case of a cell in which a write is not performed), wall charges should be formed between the address electrode and the scan electrode so that a discharge does not occur between the two electrodes, and wall charges should be formed between the scan electrode and a sustain electrode so that a discharge does not occur between the two electrodes. In this case (that is, in the case of a cell in which a write is not performed), it is preferable to form wall charges between the address electrode and the scan electrode during the reset period so that the sum of a potential difference due to the wall charges formed between the address electrode and the scan electrode and a potential difference due to a external voltage applied during the address period is less than a discharge start voltage and greater than (discharge start voltage-margin voltage). In addition, in order to prevent a discharge from occurring between the scan electrode and the sustain electrode in a state in which a scan pulse is applied to the scan electrode and a predetermined voltage is applied to the sustain electrode during the address period, it is preferable to form wall charges between the scan electrode and the sustain electrode during the reset period so that the sum of a potential difference due to the wall charges formed between the scan electrode and the sustain electrode and the potential difference due to the external voltage applied during the address period is less than the discharge start voltage.

Here, the margin voltage related to a lowest limit can be set to 40 V. The reason will be described. It is necessary to apply a voltage higher than the discharge start voltage by some degree in order to provoke a strong discharge between electrodes. When the voltage of a pulse applied to the address electrode for an address discharge is about 60–80 V, a wall voltage formed by wall charges after the reset period may be set to be lower than the discharge start voltage by 25–40 V. Accordingly, when an external voltage of about (60~80 V)–(24~40 V) is applied between two electrodes, a voltage between the two electrodes exceeds the discharge start voltage, so a strong discharge occurs between the address electrode and the scan electrode. Therefore, in the case of a panel having the conditions as described above, the margin voltage can be set to about 40 V. In the case of a panel having different conditions, a different appropriate value can be applied.

Figure 5A:
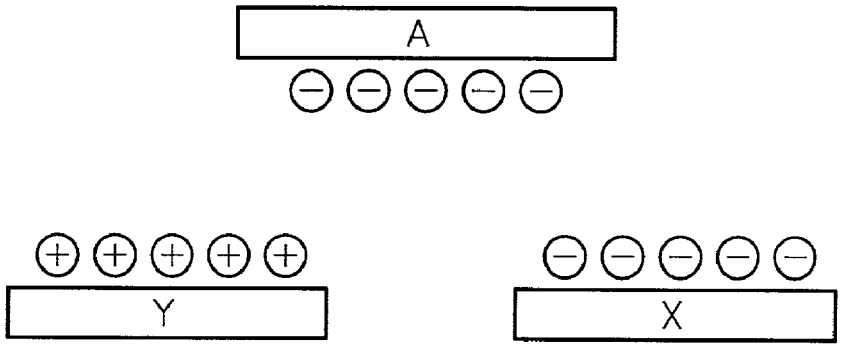
FIGS. 5A through 5C show examples of a discharge cell not meeting the addressing conditions.
Figure 5B:
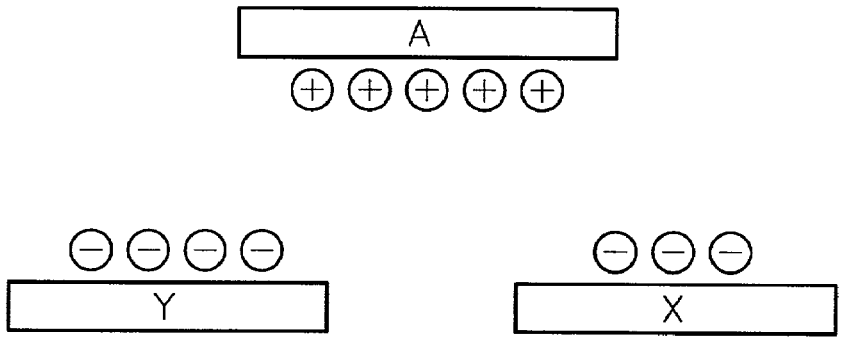

Meanwhile, several examples of the case in which a discharge cell does not satisfy the addressing conditions are as follows. In a first example, positive charges are accumulated on a scan electrode Y, and negative charges are accumulated on an address electrode A, as shown in FIG. 5A. In a second example, a wall voltage generated due to negative charges accumulated on a scan electrode Y and positive charges accumulated on an address electrode A is lower than a predetermined reference level so that an address (write) discharge does not occur even when an address voltage is applied to an address electrode A, as shown in FIG. 5B. The above two examples demonstrate that a cell has a wall charge structure in which an address discharge does not occur during an address period when a reset discharge does not occur during a reset period. In other words, in the two examples, when an address pulse and a scan pulse are applied to an address electrode and a scan electrode, respectively, during the address period, wall charges are formed between the address electrode and the scan electrode such that the sum of a potential difference due to an external voltage (an addressing voltage) and a potential difference due to the wall charges formed between the address electrode and the scan electrode does not exceed a discharge start voltage.

Figure 5C:
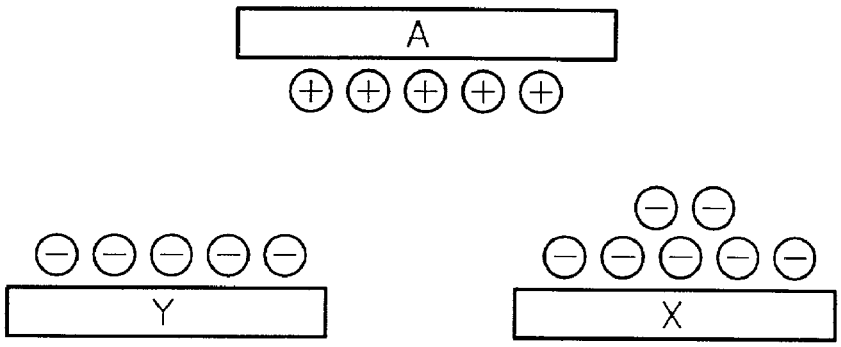

In a third example, a large amount of negative charges are accumulated on a sustain electrode X so that a sustain discharge occurs during a sustain period even if an address discharge does not occur during an address period, as shown in FIG. 5C, which is a case of erroneous operation. In other words, although an address discharge has not occurred, wall charges are formed between an address electrode and a sustain electrode such that the sum of a potential difference due to the wall charges formed between the address electrode and the sustain electrode and an external potential difference exceeds a discharge start voltage during a sustain period.

The present invention prevents a reset discharge from occurring in a discharge cell satisfying the addressing conditions, as shown in FIG. 4, and generates a reset discharge in a discharge cell which does not satisfy the addressing conditions, as shown in FIGS. 5A through 5C. Such a selective reset discharge can be accomplished by making a discharge cell satisfying the addressing conditions and a discharge cell not satisfying the addressing conditions having different discharge characteristics even if the same reset pulse signal is applied thereto, using the distribution of wall charges among the discharge cells.

Figure 7:
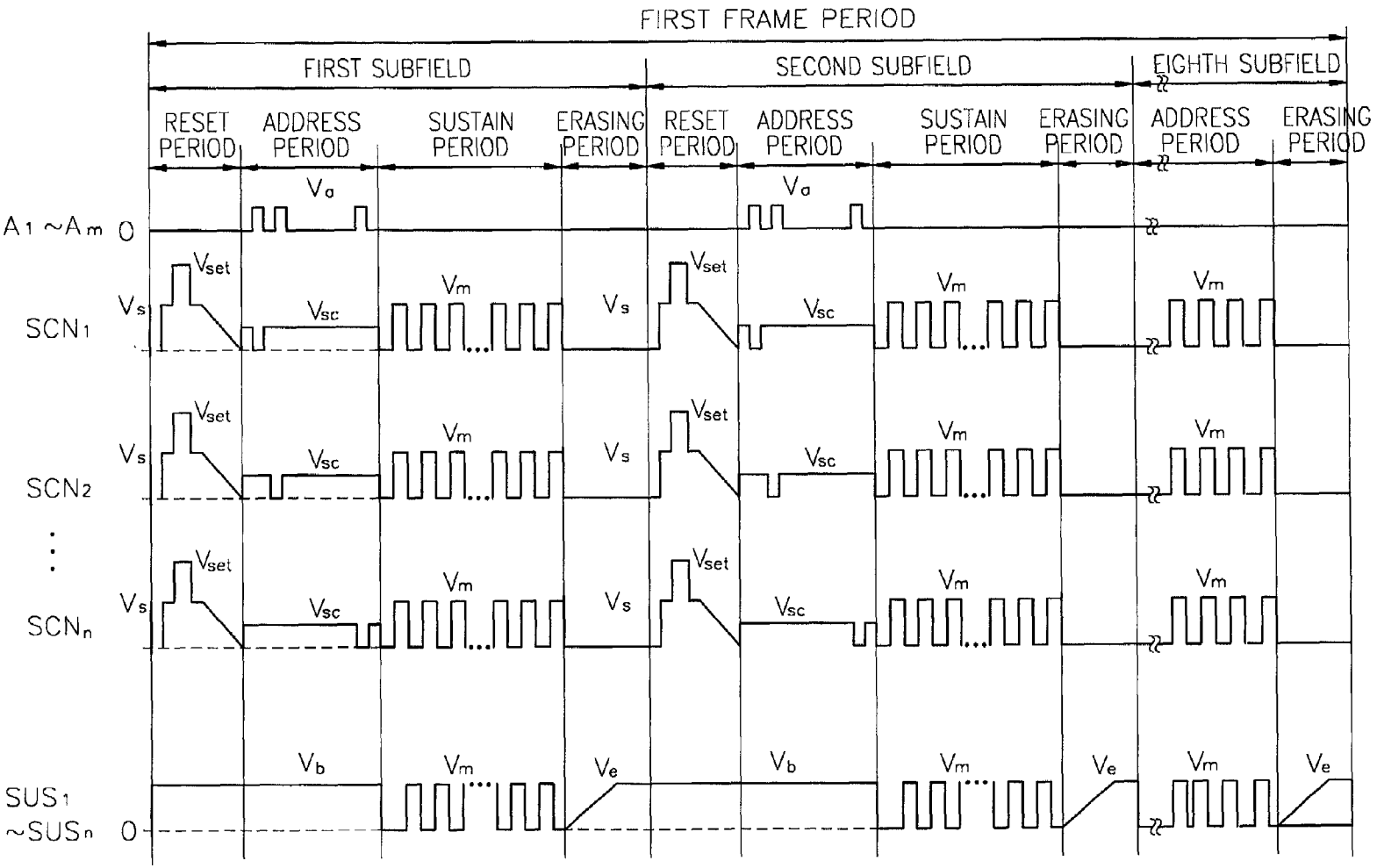
FIG. 7 is a timing chart of driving waveforms according to a method of driving a plasma display panel according to a first embodiment of the present invention.

FIG. 7 is a timing chart of driving waveforms according to a method of driving a plasma display panel according to a first embodiment of the present invention. A single frame is composed of a plurality of subfields. Each subfield is divided into a reset period, an address period, a sustain period, and an erasing period. It is apparent that this embodiment can be applied to plasma display panels in which a frame does not have a subfield structure as well as plasma display panels in which a frame has a subfield structure.

A square "reset pulse" is applied to the scan electrode(s) during an early stage of a reset period, and thereafter a "ramp pulse" decreasing linearly is applied. Meanwhile, a predetermined voltage is applied to the sustain electrode(s) so that a discharge does not occur between a scan electrode and a sustain electrode due to a reset pulse applied during the early stage of the reset period. For example, a voltage $V_b$ having a predetermined potential is applied to the sustain electrodes. The voltage $V_b$ is set to be equal to or a little higher than a sustain discharge voltage $V_m$ during the reset period and is set to be higher than or equal to the sustain discharge voltage $V_m$ during an address period. A 0 voltage is applied to address electrodes.

In a discharge cell satisfying the addressing conditions, a reset pulse voltage (or a potential difference applied between an address electrode and a scan electrode due to a reset pulse) is set such that the sum of a potential difference due to wall charges between the address electrode and the scan electrode and the potential difference applied between the address electrode and the scan electrode due to the reset pulse does not exceed a discharge start voltage. For example, it is preferable that the reset pulse voltage is set to be less than a value obtained by adding a margin voltage (for example, 40 V) to two times of the discharge start voltage. (this will be described later)

As for the highest limit of the reset pulse voltage, a voltage exceeding the discharge start voltage should be formed between the address electrode and the scan electrode in order to provoke a satisfactory discharge in a panel. The exceeding voltage corresponds to the margin voltage. Accordingly, when the margin voltage is defined as a value obtained by subtracting the discharge start voltage from an entire potential difference, which is applied between the address electrode and the scan electrode during the address discharge, (a value obtained by subtracting the right side from the left side in Equation (3), which will be described later, that is, $\alpha$ in Equation (4)), it can be applied even to a panel having different conditions.

Meanwhile, in a discharge cell which does not satisfy the addressing conditions, a reset pulse voltage (or a potential difference applied between an address electrode and a scan electrode due to a reset pulse) is set such that the sum of a potential difference due to wall charges between the address electrode and the scan electrode and the potential difference applied between the address electrode and the scan electrode due to the reset pulse exceeds a discharge start voltage. For example, it is preferable that the reset pulse voltage is set to be greater than a value obtained by subtracting an address pulse voltage from two times of the discharge start voltage or a value obtained by subtracting two times of the address pulse voltage from two times of the discharge start voltage (this will be described later).

Figure 6A:
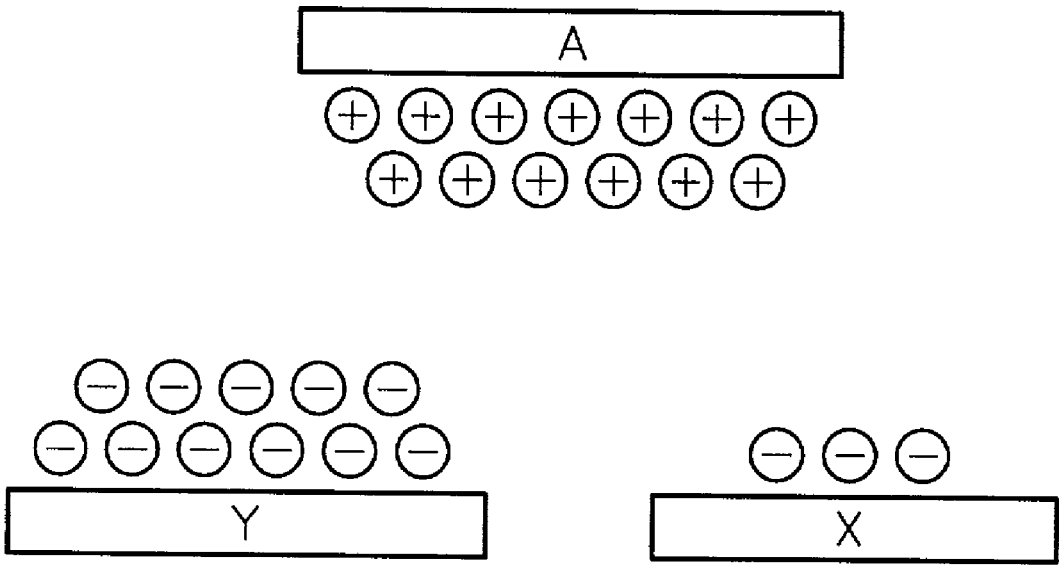
FIGS. 6A and 6B show examples of a discharge cell meeting the addressing conditions.
Figure 6B:
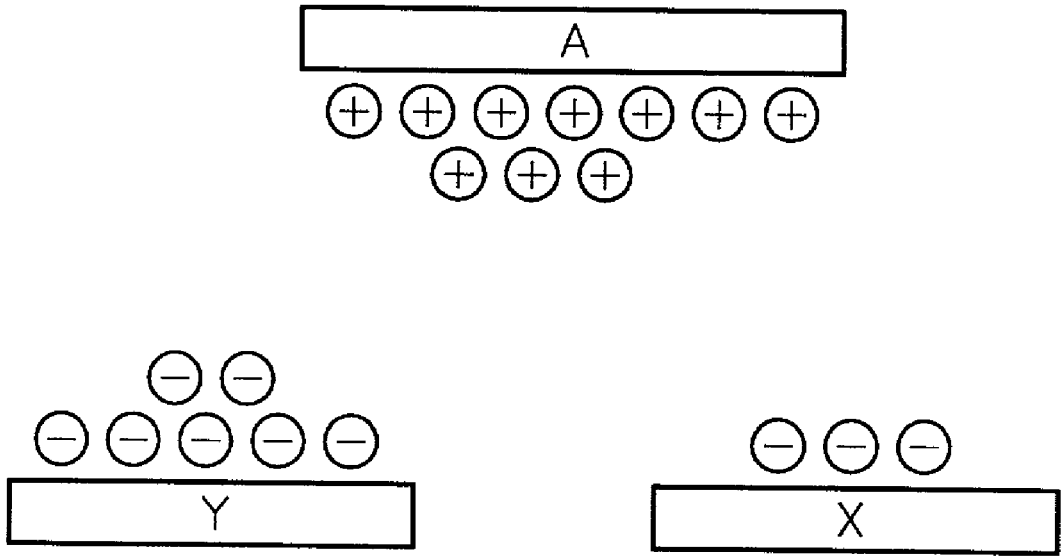

Once the square reset pulse is applied to a scan electrode, a reset discharge does not occur in a discharge cell satisfying the addressing conditions, but does occur in a cell not satisfying the addressing conditions so that a large amount of negative charges can be accumulated on the scan electrode and a large amount of positive charges can be accumulated on an address electrode. Here, enough charges are accumulated to generate an address discharge when an address voltage is applied (see FIG. 6A). Under such a distribution of charges among electrodes in the discharge cell, when a ramp pulse decreasing linearly is applied to the scan electrode, a voltage difference between the sustain electrode and the scan electrode is maintained appropriately so that the discharge cell can have a wall charge structure satisfying the addressing conditions, as shown in FIG. 6B. The ramp pulse applied during the later stage of a reset period can be realized as a pulse having a slope descending from a voltage having a predetermined level, at which a discharge does not occur between the scan electrode and the address electrode and between the scan electrode and the sustain electrode, toward a voltage having a lower level of a scan pulse or a voltage having a level higher than the lower level of the scan pulse by a predetermined level.

A discharge mechanism during a reset period will be described with reference to waveforms shown in FIG. 7. In a state in which a constant voltage is maintained at each of a sustain electrode and an address electrode, a reset voltage is applied to a scan electrode so that a reset discharge can occur between the scan electrode and the address electrode, but a discharge between the scan electrode and the sustain electrode is suppressed. In order to provoke the reset discharge between the scan electrode and the address electrode, it is preferable that a square reset pulse applied to the scan electrode has a reset voltage such that an external potential difference between the scan electrode and the address electrode is less than a value $2V_{fay}$+40 V obtained by adding predetermined margin (for example, 40 V) to two times of a discharge start voltage and greater than a value $2V_{fay}-V_a$ obtained by subtracting an address pulse voltage from two times of the discharge start voltage or a value $2V_{fay}-2V_a$ obtained by subtracting two times of the address pulse voltage from two times of the discharge start voltage (this will be described in detail later).

The reset period having such a pulse structure may be performed at the beginning of each subfield or may be selectively performed or not performed at a particular frame or subfield.

When a single frame is divided into a plurality of subfields in driving a panel, the voltage of a reset pulse which is applied during a reset period for a first subfield or some subfields of each frame or the voltage of a reset pulse which is applied during a reset period for one or more subfields of some frames among a plurality of frames can be set to be higher than the voltage of a reset pulse applied in the other subfields. In other words, the voltages of reset pulses applied during a reset period may be the same among all subfields or may be different according to the position of a subfield. For example, the voltage of a reset pulse in a first subfield of each frame can be set to be higher than in the other subfields.

In the case of a subfield having a reset pulse which is set to a voltage relatively lower than a reset pulse applied to the other subfields during a reset period, a pulse voltage applied to a scan electrode and an address electrode is set such that the sum of an external potential difference between the scan electrode and the address electrode due to the reset pulse and an address pulse and a potential difference due to wall charges accumulated between the scan electrode and the address electrode does not exceed a discharge start voltage in cells satisfying the addressing conditions and exceeds the discharge start voltage in cells which do not satisfy the addressing conditions. In the case of a subfield having a reset pulse set to a relatively higher voltage, a pulse voltage is set such that the sum of an external potential difference between a scan electrode and an address electrode and a potential difference due to wall charges accumulated between the scan electrode and the address electrode exceeds a discharge start voltage in all cells. The external potential difference between the scan electrode and the address electrode due to the reset pulse set to the relatively higher voltage is greater than that due to the reset pulse set to the relatively lower voltage and is equal to or greater than two times of the discharge start voltage.

Next, the operation in a discharge cell during a reset period will be described by cases. When a square reset pulse is applied to a scan electrode of a discharge cell which satisfies the addressing condition, as shown in FIG. 4, the voltage of the reset pulse is counterbalanced by a wall voltage which has been formed between the scan electrode having a large amount of negative charges and an address electrode having a large amount of positive charges, so a voltage actually applied between the scan electrode and the address electrode in the discharge cell is lower than the voltage of the reset pulse. Accordingly, a discharge does not occur in the discharge cell.

In the case of a discharge cell which does not satisfy the addressing conditions because positive charges are accumulated on the scan electrode and negative charges are accumulated on the address electrode, as shown in FIG. 5A, when a square reset pulse is applied to the scan electrode, an actual voltage between the scan electrode and the address electrode in the discharge cell is equal to the sum of the voltage of the reset pulse and a voltage formed by wall charges because an electric field formed between the scan electrode and the address electrode has the same polarity as the reset pulse. Accordingly, a reset discharge occurs between the scan electrode and the address electrode, thereby causing the accumulation of positive charges on the address electrode and negative charges on the scan electrode. Thereafter, once a ramp pulse is applied to the scan electrode, the discharge cell can have a wall charge structure satisfying the addressing conditions.

In the case of a discharge cell in which an address (write) discharge does not occur even if an address voltage is applied because a wall voltage formed between the scan electrode and the address electrode is lower than a predetermined reference voltage, an internal electric field is formed between the scan electrode and the address electrode, but the value of the internal electric field is small. When a voltage is applied to the scan electrode using a reset pulse, a voltage between the address electrode and the scan electrode is counterbalanced by the wall voltage which has been formed between these electrodes. However, if the level of the voltage of the square reset pulse applied to the scan electrode is set to be higher than a predetermined level taking into account the level of the wall voltage, a reset discharge can occur between the scan electrode and the address electrode even if the applied voltage is counterbalanced by the wall voltage. Therefore, sufficient positive charges can be accumulated on the address electrode and sufficient negative charges can be accumulated on the scan electrode so that the discharge cell can have a wall charge structure satisfying the addressing conditions when a ramp pulse is applied to the scan electrode thereafter. Here, since wall charges are formed on the scan and address electrodes in a direction in which the wall charges counterbalance the electric field of the reset pulse, it may be said that the discharge cell is in a state in which it is relatively difficult to generate a reset discharge using a reset pulse which is supposed to generate a reset discharge in a cell not satisfying the addressing conditions according to the present invention. In other cases not satisfying the addressing conditions such as a cell in which the scan and address electrodes do not have wall charges and a cell in which the scan and address electrodes have wall charges of the same polarity, a reset discharge can be generated by using the method used for the case shown in FIG. 5B.

Next, in the case where an error can occur in operation because a large amount of negative charges are accumulated on the sustain electrode in a discharge cell, as shown in FIG. 5C, once a square reset pulse is applied to the scan electrode, a reset discharge occurs between the scan electrode and the sustain electrode, thereby decreasing the excessive negative charges on the sustain electrode. Thereafter, a ramp pulse is applied to the scan electrode at the later stage of a reset period, and the amount of wall charges at each electrode is appropriately adjusted by the ramp pulse so that the discharge cell can have a wall charge structure satisfying the addressing conditions.

Figure 1:
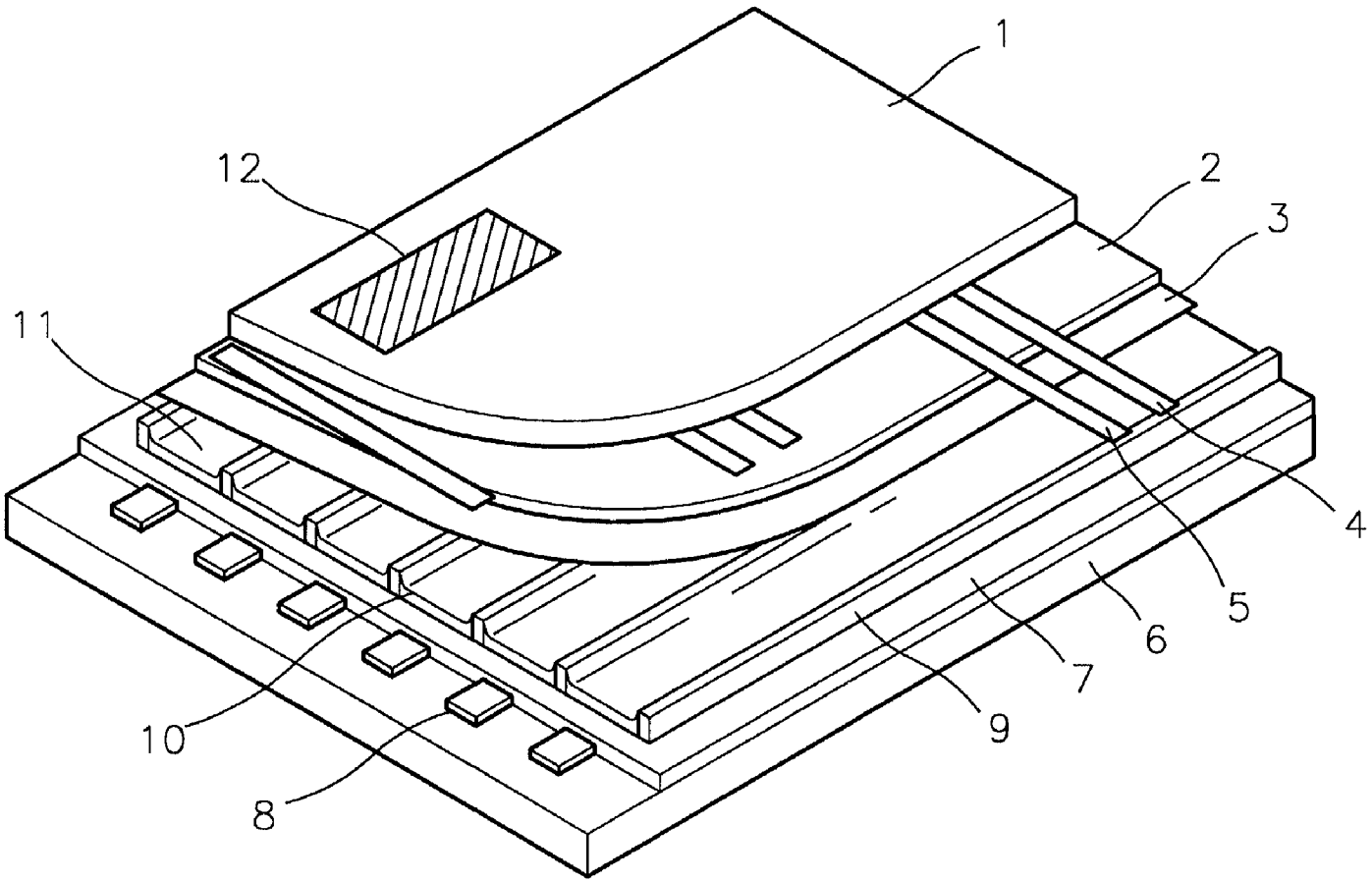
FIG. 1 is a perspective view of a part of an AC plasma display panel.
Figure 2:
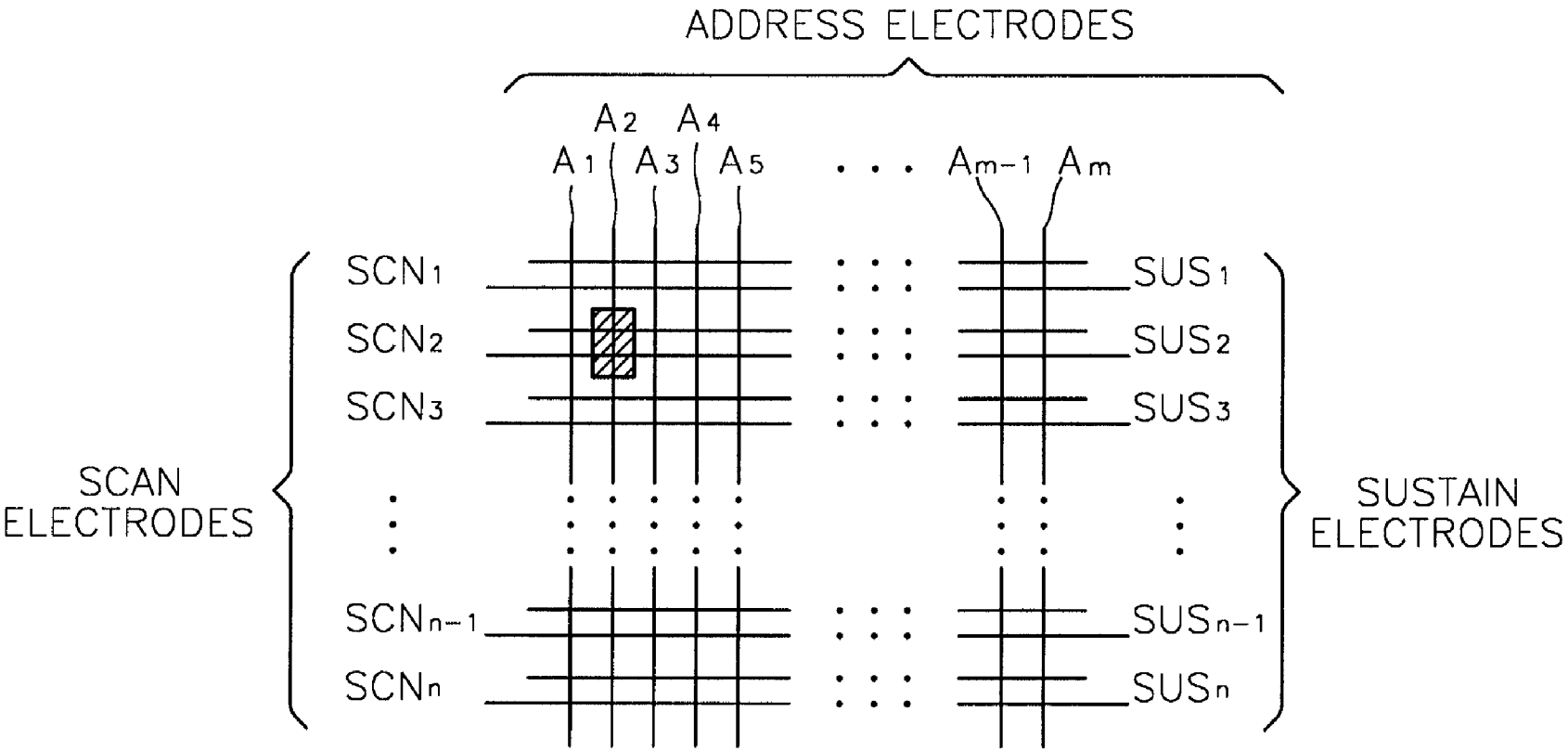
FIG. 2 is a diagram of an electrode array in a panel.
Figure 3:
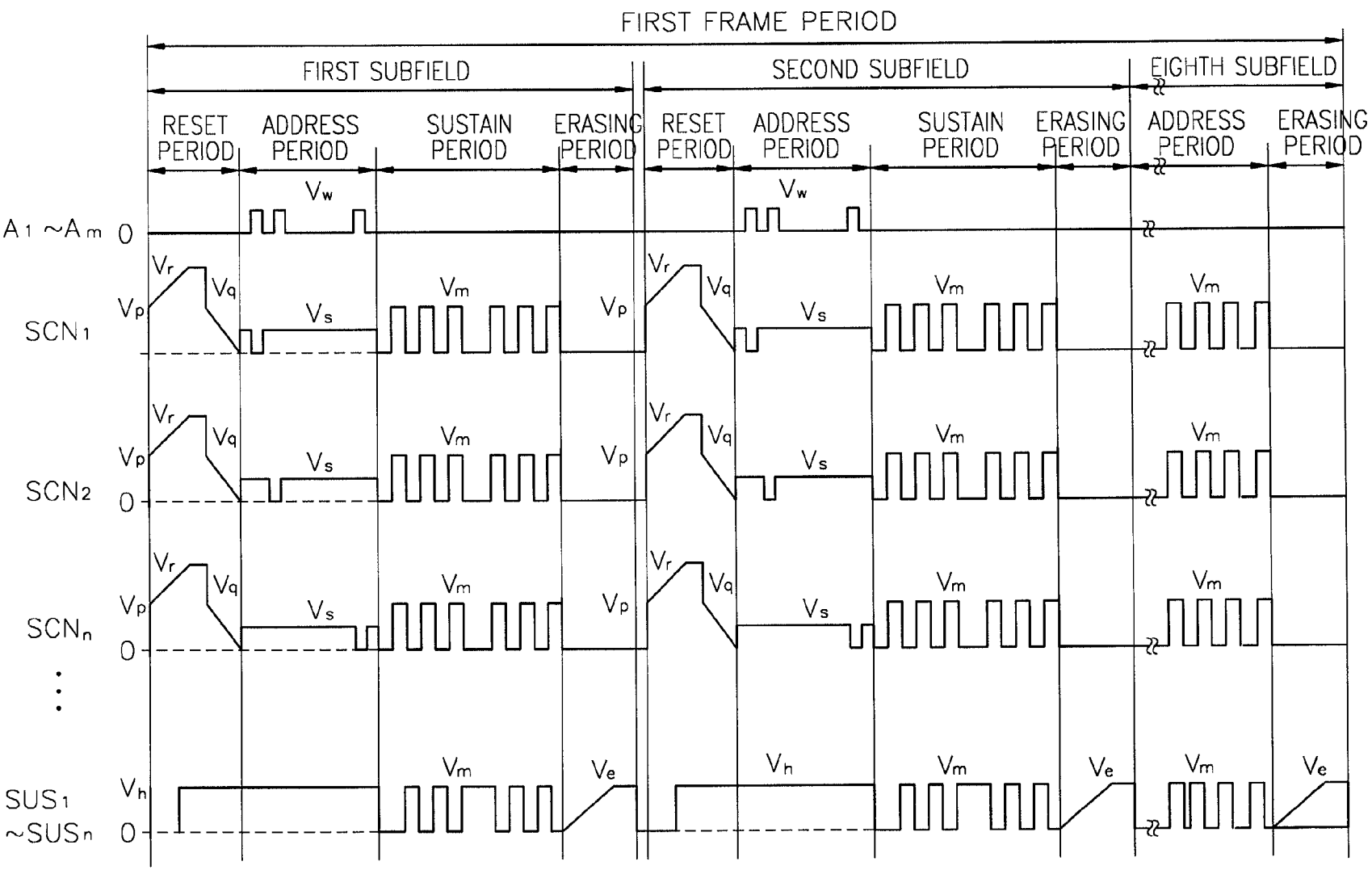
FIG. 3 is a timing chart of driving waveforms according to a conventional method of driving a panel.

The reset period is followed by an address period and a sustain period. During these periods, substantially the same operation as described in FIG. 3 is performed. Thus a detailed description thereof will be omitted. Thereafter, an erasing operation for erasing a wall charge formed by a sustain discharge during the sustain period with respect to a single subfield is performed using a ramp pulse increasing linearly from a predetermined voltage toward a voltage equal to or higher than a high level voltage of a sustain pulse during an erasing period, performing an erase discharge, as shown in FIG. 7. Alternatively, a pulse having a narrow width (a predetermined width), a pulse having a voltage lower than a voltage for a sustain discharge and having a width wider than that of a pulse for the sustain discharge, or a pulse shaped like a logarithmic waveform can be used. The erasing operation for erasing wall charges formed by a sustain discharge may not be performed.

Figure 8:
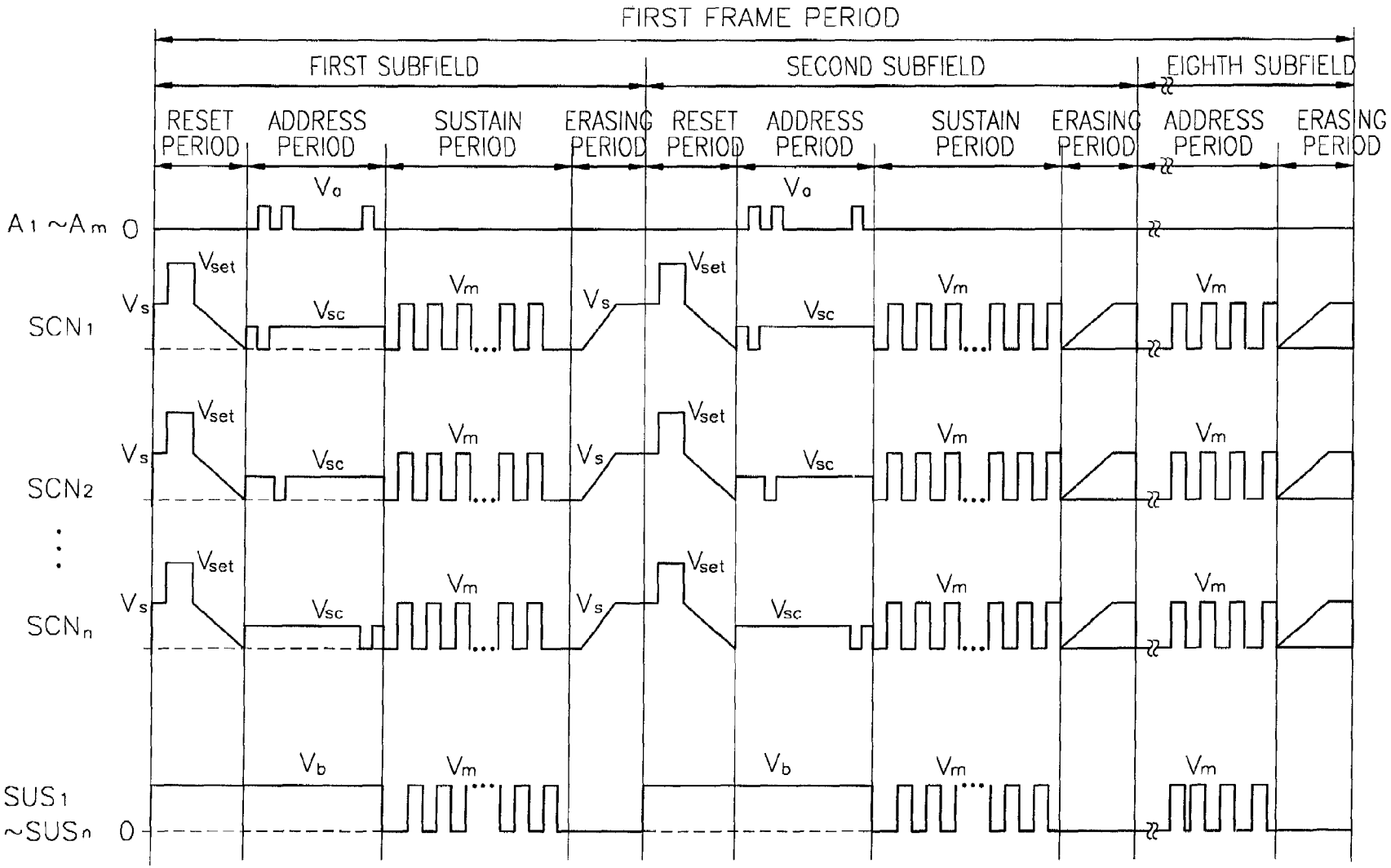
FIG. 8 is a timing chart of driving waveforms according to a method of driving a plasma display panel according to a second embodiment of the present invention.

FIG. 8 is a timing chart of driving waveforms according to a method of driving a plasma display panel according to a second embodiment of the present invention. During a reset period, signal waveforms in FIG. 8 are the same as those in FIG. 7. However, during an erasing period, an erasing pulse is applied to the sustain electrodes in FIG. 7 but is applied to the scan electrodes in FIG. 8. Besides this difference, the waveforms of FIG. 8 are substantially the same as those of FIG. 7. In addition, the driving operation of a panel is the same in FIGS. 7 and 8.

Figure 9:
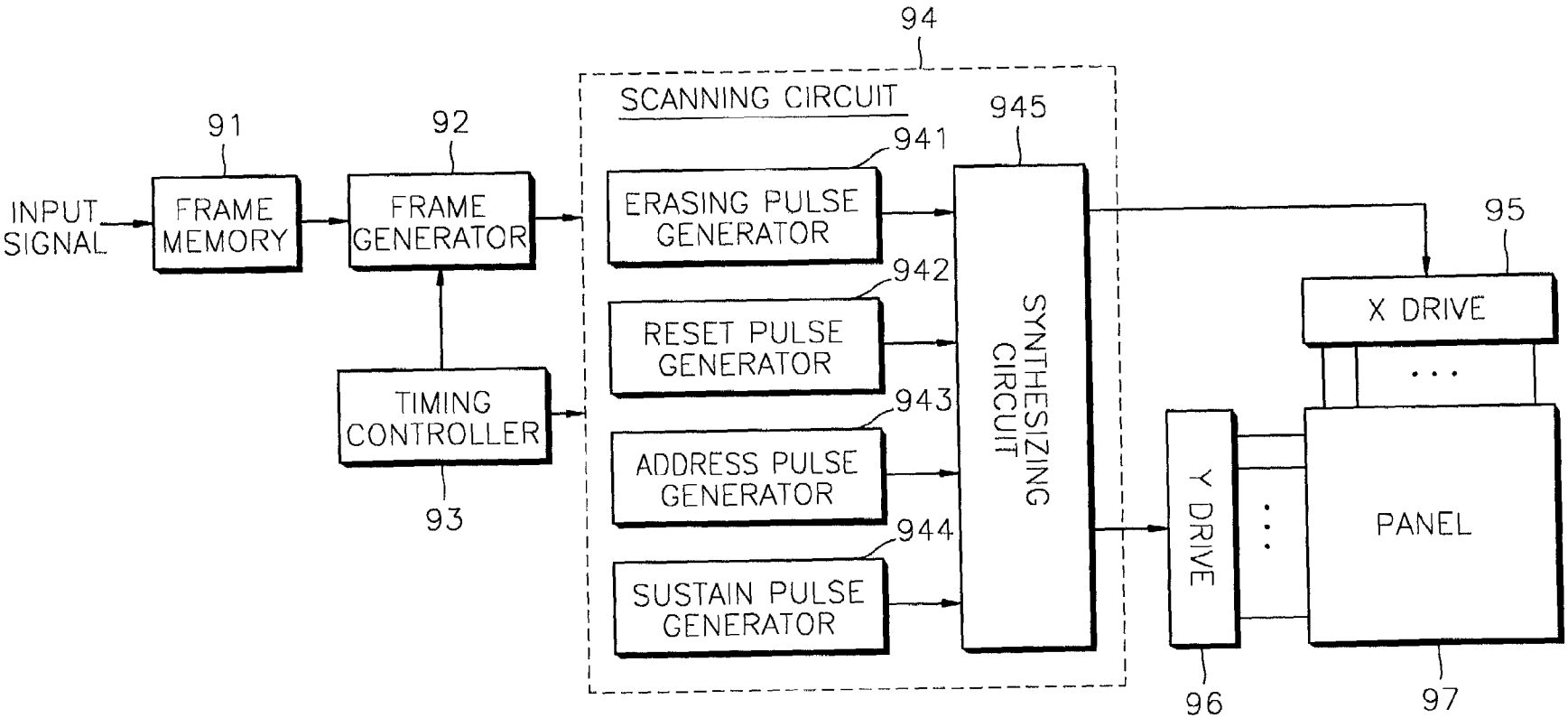
FIG. 9 is a block diagram of an apparatus for driving a plasma display panel according to an embodiment of the present invention.

FIG. 9 is a block diagram of an apparatus for driving a plasma display panel according to an embodiment of the present invention. An analog image signal to be displayed on a panel 97 is converted into digital data and stored in a frame memory 91. A frame generator 92 divides the digital data stored in the frame memory 91 at necessity and outputs the divided digital data to a scanning circuit 94. For example, for gray scale on the panel 97, the frame generator 92 divides a single frame of pixel data stored in the frame memory 91 into a plurality of subfields according to a gray level and outputs data for each subfield.

A scanning circuit 94 scans a scan electrode (Y) drive 96 and a sustain electrode (X) drive 95 of the panel 97 and includes a reset pulse generator 942, an address pulse generator 943, a sustain pulse generator 944 and an erasing pulse generator 941, for generating signal waveforms applied to electrodes during a reset period, an address period, a sustain period, and an erasing period, respectively. The reset pulse generator 942 generates a reset signal for initializing the state of each cell. The address pulse generator 943 generates an address signal for discriminating cells to be turned on from cells not to be turned on and performing an addressing operation. The sustain pulse generator 944 generates a sustain signal for discharging the cells which have been addressed by the address pulse generator 943. The erasing pulse generator 941 generates erasing pulses for erasing wall charges accumulated on electrodes by a sustain discharge. The scanning circuit 94 also includes a synthesizing circuit 945 for synthesizing the above signals and applying the synthesized signal to each electrode. A timing controller 93 generates a variety of timing signals necessary for the operations of the frame generator 92 and the scanning circuit 94.

The following description concerns operations for driving a panel according to an embodiment of the present invention, and particularly, operations during a reset period. It will be noted that the waveforms, operations, or set voltage during the reset period described referring to FIG. 7 or 8 may also be applied to the apparatus. During the other periods, the panel can be driven by a typical method, and thus a detailed description thereof will be omitted.

The reset pulse generator 942 applies a reset signal to the scan electrodes during a reset period, as shown in FIG. 7 or 8. The reset pulse generator 942 generates the reset signal such that a reset discharge cannot occur in cells satisfying the addressing conditions, that is, a cell having the conditions under which an address operation of discriminating cells to be turned on during a sustain period from cells not to be turned on during the sustain period during an address period can be exactly performed, and a reset discharge can occur in cells not satisfying the addressing conditions.

In order to perform such a function, it is preferable that the reset pulse generator 942 applies a reset pulse having a predetermined voltage level at the early stage of the reset period and applies a ramp pulse of which the voltage level gradually decreases at the latter stage of the reset period. By doing this, during the reset period, a reset discharge occurs in cells having a wall charge structure at the beginning of the reset period, in which an address discharge cannot occur even if an address voltage is applied during the address period, or in cells having a wall charge structure at the beginning of the reset period, in which a sustain discharge occurs during a sustain period although the address discharge has not occurred during the address period.

The following description concerns operations in the embodiment shown in FIG. 7 or 8 in which $V_s$=170 V (an initial voltage during a reset period), $V_{set1}$=210 V (a voltage of a reset pulse in a first subfield), $V_{set2}$=200 V (a voltage of a reset pulse in subfields other than the first subfield), $V_b$=180 V (a voltage of a sustain electrode during the reset period and an address period), $V_a$=75 V (an address voltage), and $V_{sc}$=70 V (a scan voltage). Here, $V_{set1}$ or $V_{set2}$ means a voltage corresponding to a potential difference between the initial voltage $V_s$ of the reset period and the highest voltage of a reset pulse.

(a) In the case of a discharge cell satisfying the addressing conditions, a reset pulse does not generate a discharge under the following conditions.

Wall charges have been formed so that an address discharge can occur in a discharge cell. Here, a wall voltage due to wall charges accumulated on an address electrode is represented by $V_{aw1}$, a wall voltage due to wall charges accumulated on a scan electrode is represented by $V_{yw1}$, and a discharge start voltage for generating a discharge between the address electrode and the scan electrode is represented by $V_{fay}$. During an address period, the scan electrode is maintained at a ground voltage, and a voltage applied to the address electrode is represented by $V_a$.

When a reset pulse is applied to the scan electrode, an internal voltage between the address electrode and the scan electrode is expressed by the left side of Formula (1). Since the discharge cell has a wall charge structure satisfying the addressing conditions, a voltage between the address and scan electrodes should not be greater than the discharge start voltage. Therefore, the voltage between the two electrodes can be expressed by the following formula. That is, the result of subtracting a wall voltage between the scan electrode and the address electrode from the voltage of the reset pulse is less than the discharge start voltage.

$$(V_s+V_{set})-(V_{aw1}-V_{yw1})<V_{fay} \quad (1)$$

$$\text{That is, } V_s+V_{set}<V_{fay}-V_{yw1}+V_{aw1} \quad (2)$$

Meanwhile, since the wall charge structure of the discharge cell satisfies the addressing conditions, when an address voltage is applied to the discharge cell, a discharge occurs. Accordingly, the relation between voltages can be expressed by the following formula.

$$V_a+(V_{aw1}+V_{yw1})\geqq V_{fay} \quad (3)$$

In the above formula, when $V_a$ is transposed to the right side and a value obtained by subtracting the right side from the left side is defined as α, the following formula can be made.

$$V_{aw1}-V_{yw1}=V_{fay}-V_a+\alpha,$$

$$\text{and here, } \alpha=V_a+(V_{aw1}-V_{yw1})-V_{fay}(>0) \quad (4)$$

When Formula (4) is combined with Formula (2), a formula with respect to a reset pulse voltage can be expressed as follows.

$$V_s+V_{set}<2V_{fay}-V_a+\alpha \quad (5)$$

In Formula (5), α denotes a value obtained by subtracting the discharge start voltage $V_{fay}$ from the sum of the address voltage $V_a$ and a potential difference $V_{aw1}-V_{yw1}$ due to wall charge formed on an address electrode and on a scan electrode. If a wall voltage formed between the address electrode and the scan electrode is the same as the discharge start voltage, α is the same as the address voltage $V_a$, and the reset voltage $V_s+V_{set}$ in Formula (5) becomes $2*V_{fay}$, that is, two times of the discharge start voltage. In other words, when a reset voltage which is two times of the discharge start voltage is applied during a reset period, a wall voltage formed between the address electrode and the scan electrode during the reset period is the same as the discharge start voltage. In an actual reset operation, when margin of about 40 V is set considering a pulse width, discharge delay, and the strength of a discharge, the highest limit of the reset voltage is $2*V_{fay}+40$ V.

(b) In the case of a discharge cell having a wall charge structure in which an address discharge cannot occur during an address period, as shown in FIG. 5A or 5B, wall voltages due to wall charges accumulated on the scan electrode and an address electrode immediately before a reset pulse is applied during a reset period are represented by $V_{yw2}$ and $V_{aw2}$, respectively, and the other parameters are the same as those in the case (a). When a reset pulse is applied, an internal electric field between the address electrode and the scan electrode can be expressed by the left side of the following formula, and the following conditions should be satisfied in order to generate a reset discharge between the address electrode and the scan electrode using the reset pulse during the reset period. In other words, the result of summing a reset pulse voltage and a wall voltage between the scan electrode and the address electrode is equal to or greater than a discharge start voltage.

$$(V_s+V_{set})+(V_{yw2}-V_{aw2})>V_{fay} \quad (6)$$

$$\text{That is, } V_s+V_{set}>V_{fay}-V_{yw2}+V_{aw2} \quad (7)$$

Meanwhile, since an address discharge cannot occur during an address period in the current wall charge structure, the following conditions are satisfied during the address period. That is, a voltage between the scan electrode and the address electrode is less than a discharge start voltage even if an address voltage is applied to the address electrode during the address period.

$$V_a+(V_{aw2}-V_{yw2})<V_{fay} \quad (8)$$

$$V_{aw2}-V_{yw2}=V_{fay}-V_a-\beta,$$

$$\text{and here, } \beta=V_{fay}-(V_a+V_{aw2}-V_{yw2})\ (>0) \quad (9)$$

When Formula (9) is combined with Formula (7), a formula with respect to a reset pulse voltage can be expressed as follows.

$$V_s+V_{set}>2V_{fay}-V_a-\beta \quad (10)$$

In Formula 10, β denotes the difference between the discharge start voltage $V_{fay}$ and the sum of the address voltage $V_a$ and the wall voltage $V_{aw2}-V_{yw2}$ formed between an address electrode and a scan electrode. When a cell cannot be addressed, there is little wall voltage formed between the address electrode and the scan electrode, or even if some wall charges are accumulated between the two electrodes, the wall voltage does not exceed a discharge start voltage when an address voltage is applied.

In the case where there is little wall voltage, the wall voltage $V_{aw2}-V_{yw2}$ approximates to zero, and β in Formula (10) becomes the difference between the discharge start voltage and the address voltage. Consequently, a reset voltage should be greater than the discharge start voltage. In the case where the wall voltage does not exceed the discharge start voltage, when the sum of the address voltage and the wall voltage, i.e., $V_a+V_{aw2}-V_{yw2}$, is just a little less than the discharge start voltage, β approximates to zero. Consequently, the reset voltage should be greater than $2V_{fay}-V_a$, that is, a value obtained by subtracting the address voltage from two times of the discharge start voltage. Taking into account the two above-described cases, it is preferable to set the lowest limit of a reset voltage to $2(V_{fay}-V_a)$ considering errors or operating margin although a theoretical lowest limit is $2V_{fay}-V_a$.

In other words, a reset voltage should be highest when positive charges are formed on an address electrode and negative charges are formed on a scan electrode in a state in which a little more wall voltage must be added to Address Voltage Va additionally for provoking an address discharge. Here, a wall voltage formed in reverse direction to the polarity of a reset pulse should be counterbalanced, and a discharge start voltage should be newly formed. Accordingly, a value $2V_{fay}-V_a$ obtained by subtracting the address voltage from two times of the discharge start voltage is the lowest voltage value of the reset pulse satisfying all conditions. A predetermined amount of margin can be considered taking into account the operating characteristics of a panel in addition to such a theoretical lowest limit.

(c) In this case, a discharge cell has a wall charge structure as shown in FIG. 5C, that is, a discharge occurs between the address electrode and the sustain electrode because an excessive amount of negative charges have been formed at the sustain electrode when the potential of the sustain electrode is grounded at the end of an address period. For a discharge cell having such a wall charge structure, in the present invention, a discharge is generated between the sustain electrode and the scan electrode using a reset pulse to remove the excessive negative charges from the sustain electrode. As a result, positive charges are accumulated on the sustain electrode. These positive charges do not influence an address operation because they can be erased by a ramp pulse during a reset period. On the contrary, the positive charges accumulated on the sustain electrode form an appropriate electric field between the sustain electrode and the scan electrode so that they can favorably act on the address operation.

When wall voltages due to wall charges on the scan electrode and the address electrode immediately before the reset pulse is applied during the reset period are represented by $V_{yw3}$ and $V_{aw3}$, respectively, a wall voltage due to wall charges on the sustain electrode which allow a discharge to occur between the address electrode and the sustain electrode when the potential of the sustain electrode drops from $V_b$ to ground at the end of the address period is represented by $V_{xx}$, a discharge start voltage between the address electrode and the sustain electrode is represented by $V_{fax}$, and a discharge start voltage between the scan electrode and the sustain electrode is represented by $V_{fxy}$, an erroneous discharge occurs between the address electrode and the sustain electrode under the following conditions.

$$V_{aw3}-V_{xx}\geqq V_{fax} \tag{11}$$

$$-V_{xx}=V_{fax}-V_{aw3}+\gamma,$$

$$\text{and here, } \gamma=V_{aw3}-V_{xx}-V_{fax}(>0) \tag{12}$$

In order to generate a discharge between the sustain electrode and the scan electrode using the reset pulse, the following condition should be satisfied.

$$(V_s+V_{set})-V_b+(V_{yw3}-V_{xx})>V_{fxy} \tag{13}$$

When Formula (12) is combined with Formula (13), the following formula is made.

$$(V_s+V_{set})-V_b>V_{fxy}-V_{yw3}-V_{fax}+V_{aw3}-\gamma \tag{14}$$

For example, when $V_{fay}$=230 V, $V_{fxy}$=260 V, and $V_a$=70 V, the voltage condition of the reset pulse is expressed by the following formula obtained from Formula (5). That is, the condition under which a reset discharge does not occur in a discharge cell satisfying the addressing conditions can be expressed by Formula (15).

$$V_s+V_{set}<390V+\alpha \tag{15}$$

Next, the condition under which a reset discharge occurs in a discharge cell not satisfying the addressing conditions as shown in FIG. 5A or 5B is expressed by the following formula obtained from Formula (10).

$$V_s+V_{set}>390V-\beta \tag{16}$$

In addition, in the case of a discharge cell where an erroneous discharge can occur, as shown in FIG. 5C, when it is assumed that $V_{aw1}$=70 V and $V_{yw2}$=−80 V, the following condition should be satisfied in order to generate a discharge in the discharge cell using a reset pulse.

$$V_s+V_{set}-V_b>180V-\gamma \tag{17}$$

When the voltage of a reset pulse is set according to the conditions of Formulae (15) through (17), a reset discharge does not occur in a cell satisfying the addressing condition and only occurs in a cell not satisfying the addressing conditions. In other words, on condition that the voltage of a reset pulse is less than the right side of Formula (15), Formula (16) should be satisfied in the case of FIG. 5A or 5B, and Formula (17) should be satisfied in the case of FIG. 5C. Accordingly, the range of the voltage of a reset pulse is set considering an electrode structure or the distribution of wall charges. Even if the wall charge structures of discharge cells are different as shown in FIGS. 4 through 5C, the voltage of a reset pulse can be appropriately selected from the range conditioned on the above formulae, thereby performing a selective reset discharge.

When considering the case where a cell which has satisfied the addressing conditions naturally loses wall charges as time elapses until it no longer satisfies the addressing conditions, or the case where there is a difference in a discharge start voltage among cells due to a difference in physical characteristics among the cells, the operating range of a waveform can be advantageously secured by securing the predetermined ranges of α, β, and γ in Formulae (15) through (17). For this, the voltage of a reset pulse is set to be higher in a first subfield of each frame or in a certain subfield among a plurality of frames than in the other subfields thereof. Thus, although a reset discharge occurs in some of the cells satisfying the addressing conditions in the subfield having the higher voltage of a reset pulse, it may be more advantageous to allow a reset discharge to occur in cells in an obscure state at the boundary between a state satisfying the addressing conditions and a state not satisfying the addressing conditions.

While contrast was 500:1 when a reset operation was performed according to a conventional method, as shown in FIG. 3, contrast was improved to over 15000:1 when a reset operation was performed according to an embodiment of the present invention. In addition, while the time of a reset period is about 290*12=3480 μs according to a conventional method, the time of a reset period is about 120*12=1440 μs according to an embodiment of the present invention. According to the present invention, since a reset discharge is selectively performed, the time of a reset period can be reduced to about 41%.

As described above, in a method and apparatus for driving a plasma display panel according to the present invention, during a reset period, a reset discharge does not occur in cells satisfying the addressing conditions and only occurs in cells not satisfying the addressing conditions so that an unnecessary reset discharge can be suppressed, thereby making a dark portion darker. Therefore, contrast can be greatly improved, and a time for a reset period can be reduced.

What is claimed is:

1. A method of driving a plasma display panel, the method including a reset period for initializing the state of each cell, an address period for discriminating cells to be turned on from cells not to be turned on during a sustain period, the sustain period for discharging the addressed cells, the method comprising:

in a single reset period, applying a reset signal that prevents a reset discharge from occurring in cells having conditions under which an address discharge can occur during the address period and that allows a reset discharge to occur in cells which do not have the conditions.

2. The method of claim 1, wherein the reset signal is applied so that a reset discharge occurs in a cell having a wall charge structure in which an address discharge cannot occur even if an address voltage is applied during the address period, or in a cell having a wall charge structure in which a sustain discharge occurs during the sustain period even if an address discharge does not occur during the address period, when determined based on the wall charge structure of the cell at the beginning of the reset period.

3. The method of claim 1, wherein the reset signal is applied so that a reset discharge is prevented from occurring in a cell having conditions under which an address discharge can occur therein when an address voltage is applied during the address period because a large amount of negative charges are accumulated on the scan electrode and a large amount of positive charges are accumulated on the address electrode in the cell.

4. The method of claim 1, wherein the reset signal is applied so that a reset discharge is generated in a cell having conditions under which an address discharge cannot occur therein even if an address voltage is applied during the address period because positive charges are accumulated on the scan electrode and negative charges are accumulated on the address electrode.

5. The method of claim 1, wherein the reset signal is applied so that a reset discharge is generated in a cell having conditions under which an address discharge cannot occur therein even if an address voltage is applied during the address period because a wall voltage formed from negative charges accumulated on the scan electrode and positive charges accumulated on the address electrode is lower than a predetermined reference voltage.

6. The method of claim 1, wherein the reset signal is applied so that a reset discharge is generated in a cell where wall charges are not substantially formed on the scan or address electrode or where wall charges having the same polarity are formed on the scan and address electrodes.

7. The method of claim 1, wherein the reset signal is applied so that a reset discharge is generated in a cell having conditions under which a sustain discharge can occur therein during the sustain period even if an address discharge does not occur during the address period.

8. The method of claim 1, wherein when a single frame is divided into a plurality of subfields, the voltage of a reset pulse applied during the reset period in one or more subfields of each frame or in one or more subfields in one or more frames among a plurality of frames is set to be higher than the voltage of a reset pulse applied during the reset period in the other subfields.

9. The method of claim 1, wherein a reset waveform is applied during the reset period, wherein a reset pulse having a predetermined voltage level is applied in an early stage of the reset period, and a ramp pulse having a gradually decreasing voltage level is applied in a latter stage of the reset period.

10. The method of claim 9, wherein after the expiration of the sustain period, a pulse signal having a predetermined width is applied to a sustain or scan electrode, or a ramp signal having a gradually increasing voltage from a predetermined voltage to a voltage same as or higher than a high level voltage of a sustain pulse, is applied to the sustain or scan electrode, thereby performing an erase discharge.

11. The method of claim 9, wherein a voltage applied to the sustain electrode is constant in the reset period.

12. The method of claim 9, wherein when a single frame is divided into a plurality of subfields, a voltage level of the reset pulse applied in at least one subfield is different from that in the other subfields.

13. The method of claim 1, wherein when a reset voltage is applied to a scan electrode in the reset period while voltages applied to a sustain and address electrodes, respectively, are maintained constant so that a reset discharge is substantially generated between the scan and address electrodes and substantially prevented form occurring between the scan and sustain electrodes.

14. A method of driving a plasma display panel, the method including a reset period for initializing the state of each cell, an address period for discriminating cells to be turned on from cells not to be turned on during a sustain period, the sustain period for discharging addressed cells, the method comprising:

applying a reset waveform during the reset period, wherein a reset pulse having a predetermined voltage level is applied in an early stage of the reset period, and a ramp pulse having a linearly decreasing voltage level is applied in a latter stage of the reset period, wherein a reset discharge is prevented from occurring in cells having conditions under which an address discharge can occur during the address period and a reset discharge is allowed to occur in cells which do not have the conditions.

15. The method of claim 14, wherein after the expiration of the sustain period, a pulse signal having a predetermined width is applied to a sustain or scan electrode, or a ramp signal having a gradually increasing voltage from a predetermined voltage to a voltage the same as or higher than a high level voltage of a sustain pulse is applied to the sustain or scan electrode, thereby performing an erase discharge.

16. The method of claim 14, wherein a voltage applied to the sustain electrode is constant in the reset period.

17. The method of claim 14, wherein when a single frame is divided into a plurality of subfields, a voltage level of the reset pulse applied in at least one subfield is different from that in the other subfields.

18. The method of claim 14, wherein the ramp pulse gradually decreases from a predetermined voltage to a voltage the same as or higher than a low level voltage of a scan pulse.

19. The method of claim 14, wherein when a single frame is divided into a plurality of subfields, a voltage of the reset pulse applied in at least one subfield is set to be higher than a voltage of the reset pulse applied in the other subfields.

20. The method of claim 14, wherein a reset discharge is prevented from occurring in a cell having conditions under which an address discharge can occur therein due to an address voltage during the address period, when determined based on the wall charge structure of the cell at the beginning of the reset period.

21. A method of driving a plasma display panel, the method including a reset period for initializing the state of each cell, an address period for discriminating cells to be turned on from cells not to be turned on during a sustain period, wherein said sustain period discharges addressed cells, the method comprising:

applying a reset voltage to a scan electrode in the reset period while voltages applied to sustain and address electrodes, respectively, are maintained constant so that a reset discharge substantially occurs between the scan and address electrodes and is substantially prevented from occurring between the scan and sustain electrodes.

22. The method of claim 21, wherein the reset voltage is applied to the scan electrode in a waveform of a rectangular pulse.

23. The method of claim 21, wherein when a single frame is divided into a plurality of subfields, a voltage level of the reset pulse applied in at least one subfield is different from that in the other subfields.

24. The method of claim 22, wherein after the rectangular pulse is applied, a ramp pulse gradually decreasing from a predetermined voltage to a voltage the same as or higher than a low level voltage of a scan pulse is applied.

25. An apparatus for driving a plasma display panel, the apparatus comprising:

a reset signal generator for generating a reset signal for initializing the state of each cell;

an address signal generator for generating an address signal for discriminating a cell to be turned on from a cell not to be turned on; and a sustain signal generator for generating a sustain signal for discharging a cell addressed by the address signal generator, wherein the reset signal generator generates the reset signal to prevent a reset discharge from occurring in a cell satisfying conditions under which an address discharge can be normally performed due to the address signal and to generate a reset discharge in a cell which does not satisfy the conditions.

26. The apparatus of claim 25, wherein the reset signal generator applies a reset pulse having a predetermined voltage level in an early stage of a reset period and applies a ramp pulse having a gradually decreasing voltage level in a latter stage of the reset period.

27. The apparatus of claim 25, wherein the reset signal generator generates the reset signal so as to generate a reset discharge in a cell having conditions under which a sustain discharge can occur even if an address discharge does not occur during an address period, when determined based on the state of the cell at the beginning of a reset period.

28. The apparatus of claim 25, wherein the reset signal generator generates the reset signal having a constant voltage in the reset period.

29. The apparatus of claim 25, wherein when a single frame is divided into a plurality of subfields, the voltage of a reset pulse applied during the reset period in one or more subfields of each frame or in one or more subfields in one or more frames among a plurality of frames is set to be higher than the voltage of a reset pulse applied during the reset period in the other subfields.

30. The apparatus of claim 25, wherein when the reset signal is applied to a scan electrode in the reset period while voltages applied to a sustain and address electrodes maintain constantly respectively, a reset discharge is substantially generated between the scan and address electrodes and substantially prevented from occurring between the scan and sustain electrodes.

* * * * *